US009650989B2

(12) United States Patent
Staley et al.

(10) Patent No.: US 9,650,989 B2
(45) Date of Patent: May 16, 2017

(54) DIMPLED SURFACE FEATURES FOR RADIATED NOISE ATTENUATION IN ENGINE FRONT COVERS

(71) Applicant: GM Global Technology Operations LLC, Detroit, MI (US)

(72) Inventors: Eric D. Staley, Flushing, MI (US); Alan W. Hayman, Romeo, MI (US); Thomas A. Spix, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 731 days.

(21) Appl. No.: 13/763,281

(22) Filed: Feb. 8, 2013

(65) Prior Publication Data

US 2014/0224206 A1 Aug. 14, 2014

(51) Int. Cl.
*F02B 77/00* (2006.01)
*F02F 7/00* (2006.01)

(52) U.S. Cl.
CPC ..... *F02F 7/008* (2013.01); *F02F 7/0073* (2013.01); *F02F 2007/0075* (2013.01)

(58) Field of Classification Search
CPC ..... F05D 2240/14; F05D 2250/60
USPC ..... 123/195 C, 192.1, 192.2, 193.4, 195 R
See application file for complete search history.

(56) References Cited

U.S. PATENT DOCUMENTS

| | | | | |
|---|---|---|---|---|
| 4,294,333 | A * | 10/1981 | Little | 184/106 |
| 6,536,398 | B2 * | 3/2003 | Neal | 123/195 C |
| 7,594,405 | B2 * | 9/2009 | Somanath et al. | 60/796 |
| 7,669,573 | B2 * | 3/2010 | Ogasawara et al. | 123/192.2 |
| 2004/0149250 | A1 * | 8/2004 | Gschwindt | F01L 1/02 123/195 C |
| 2004/0228554 | A1 * | 11/2004 | Fujita | F16C 9/02 384/291 |
| 2005/0241605 | A1 * | 11/2005 | Bedwell | F02M 29/14 123/184.21 |
| 2007/0144479 | A1 * | 6/2007 | Kochi | F02F 7/0004 123/193.2 |
| 2009/0188465 | A1 * | 7/2009 | Iwata | F02F 7/0073 123/195 C |
| 2011/0162614 | A1 * | 7/2011 | Lapp | F16J 1/14 123/197.3 |

* cited by examiner

*Primary Examiner* — Marguerite McMahon
*Assistant Examiner* — James Kim
(74) *Attorney, Agent, or Firm* — Harness, Dickey & Pierce, P.L.C.

(57) ABSTRACT

An engine assembly is provided including a block defining a plurality of cylinders. A plurality of pistons are disposed in the plurality of cylinders and a crankshaft is drivingly attached to the plurality of pistons. A cover is mounted to an end of the block and supports a crankshaft seal around the crankshaft. The cover includes a dimpled pattern in a surface adjacent to the crankshaft seal.

19 Claims, 5 Drawing Sheets

DIMPLED SURFACE FEATURES FOR RADIATED NOISE ATTENUATION IN ENGINE FRONT COVERS

FIELD

The present disclosure relates to internal combustion engines, and more particularly, to an engine assembly having a front cover with a dimpled surface that will attenuate panel resonances by radiating the sound waves in multiple directions.

BACKGROUND

This section provides background information related to the present disclosure which is not necessarily prior art.

An internal combustion engine typically includes an engine block defining a plurality of cylinders. A plurality of pistons are disposed in each of the cylinders and are drivingly attached to a crankshaft which can be rotatably mounted at the base of the engine block. A cylinder head is typically mounted to the engine block to enclose the top of each cylinder to define a plurality of combustion chambers between the cylinder head and the top surface of the pistons. The cylinder head typically includes intake and exhaust ports that communicate with the combustion chambers. Fuel can be supplied to the combustion chamber via the intake port or via a separate fuel injector that injects fuel directly into the combustion chamber. A spark plug can be utilized for igniting an air fuel mixture within the combustion chamber. The combustion process within each of the combustion chambers is strategically timed so that the crankshaft is driven by the pistons. An engine front cover is typically mounted to the block and includes an opening therein that supports a crankshaft seal that seals an end of the crankshaft. The front cover can also cover some timing chains or belts that are typically used for driving the camshafts, water pump, and other vehicle accessories.

The surfaces of an engine front cover near the front crankshaft seal are typically flat panels, which act as a speaker for radiated noise. This area is also very close to surrounding components, which limits the amount of structural ribbing that can be added.

SUMMARY

This section provides a general summary of the disclosure, and is not a comprehensive disclosure of its full scope or all of its features.

The present disclosure provides an engine assembly including a block defining a plurality of cylinders. A plurality of pistons are disposed in the plurality of cylinders and a crankshaft is drivingly attached to the plurality of pistons. A cover is mounted to an end of the block and supports a crankshaft seal around the crankshaft. The cover includes a dimpled pattern in a surface adjacent to the crankshaft seal in order to attenuate panel resonances by radiating the sound waves in multiple directions.

According to alternative aspects of the present disclosure, the dimpled pattern can include a plurality of spaced recessed dimples, or a plurality of spaced protruding dimples. The dimpled pattern can include dimples that are evenly sized or that have differing sizes. The dimpled pattern can include dimples that are generally evenly spaced or unevenly spaced so as to provide an asymmetric pattern. The dimpled pattern can be provided in the area completely surrounding the crankshaft seal or can be provided so as to only cover a portion of the area surrounding the crankshaft seal, or can cover a majority of the front cover surface.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
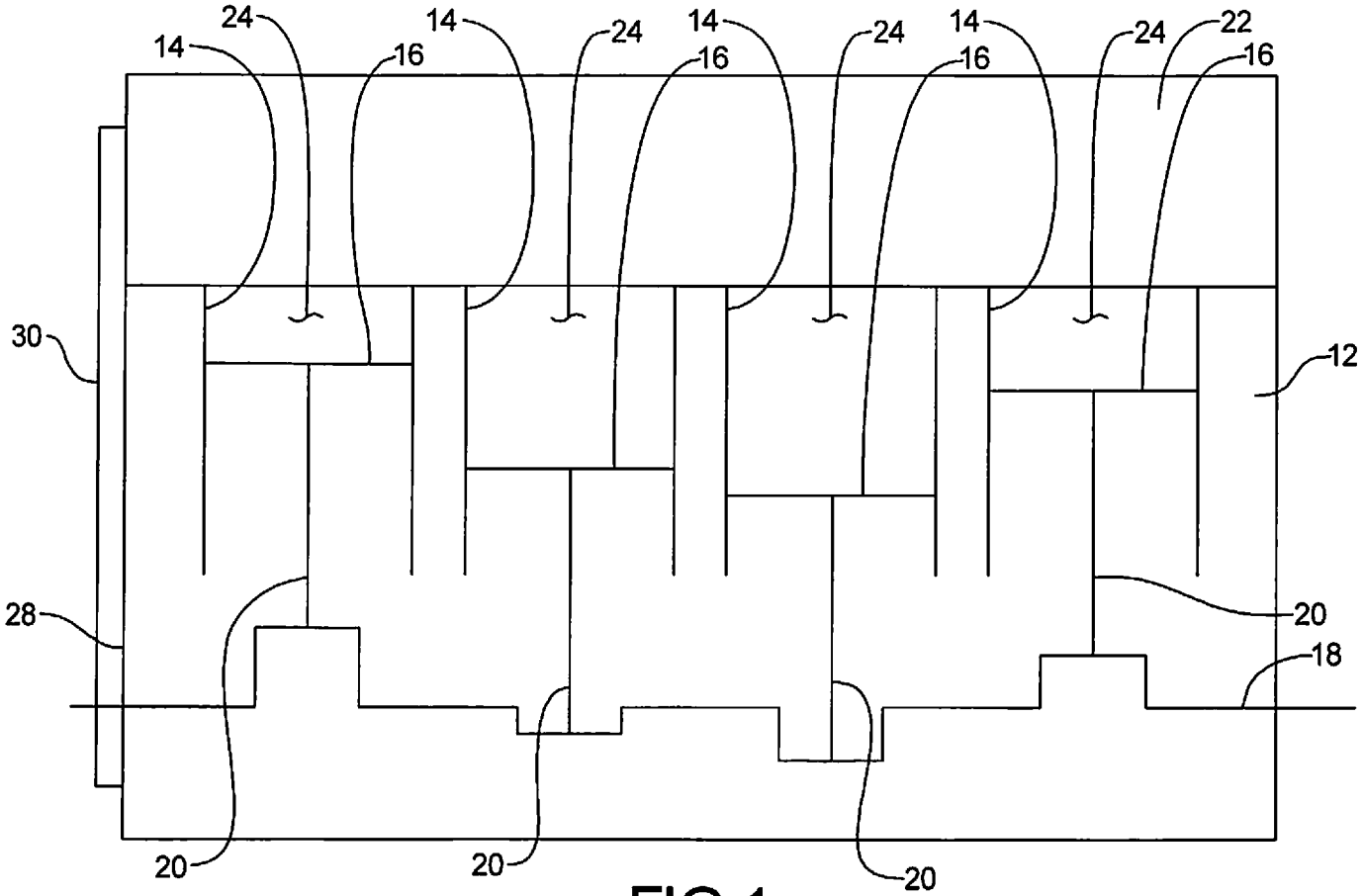
FIG. 1 is a schematic view of an engine assembly, according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, an engine assembly according to the principles of the present disclosure will now be described. The engine assembly 10 includes a block 12 defining a plurality of cylinders 14 that can be in either an in-line configuration, a V-configuration, or other known configurations. A plurality of pistons 16 are disposed in the plurality of cylinders and are drivingly connected to a crankshaft 18 by a connecting rod 20. A cylinder head 22 is mounted to the block 12 and defines an upper surface of a plurality of combustion chambers 24 disposed between the tops of the pistons 16 and the cylinder head 22. The cylinder head 22 can include a plurality of intake and exhaust ports in communication with each of the combustion chambers 24, as is known in the art. As is also known in the art, the crankshaft 18 can be drivingly connected to a camshaft and other vehicle accessories such as a water pump and generator via chains or belts that are disposed at one end of the engine 10. A front cover 30 is provided for covering an end of the engine 10 and includes an opening 32 that receives a crankshaft seal 28 that sealingly engages the crankshaft as it extends from the engine assembly.

Figure 2:
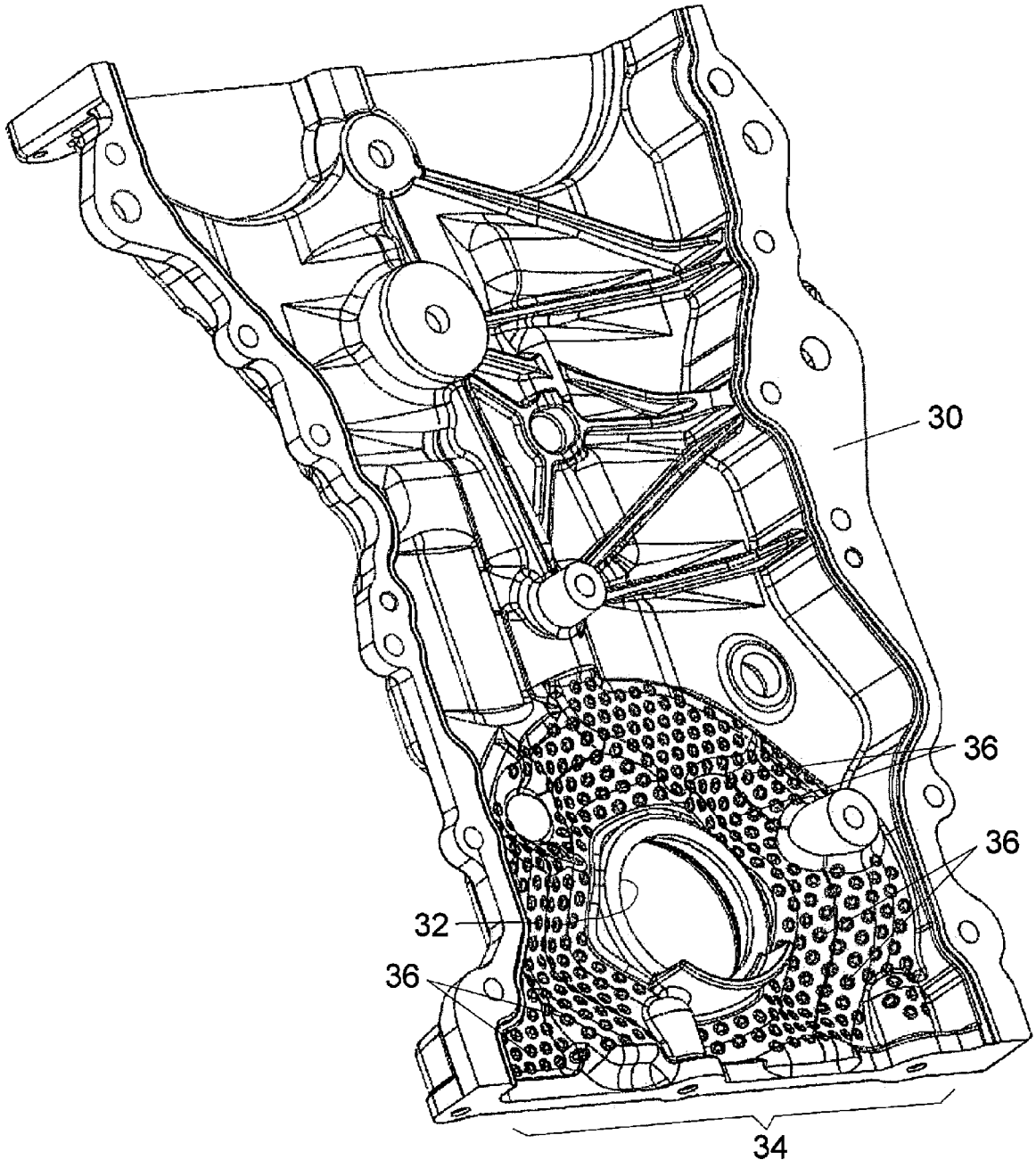
FIG. 2 is a perspective view of a portion of an engine front cover having a recessed dimple pattern, according to the principles of present disclosure.

With reference to FIG. 2, an exemplary engine front cover 30, according to the principles of the present disclosure, will now be described. The engine front cover 30 includes an opening 32 that supports the crankshaft seal in sealing engagement with the crankshaft as it extends from the engine assembly 10. The cover 30 includes a dimpled pattern 34 in the surface adjacent to the crankshaft seal. The dimpled pattern 34 can include a plurality of spaced, recessed, dimples 36, as shown in FIG. 2. As illustrated in FIG. 2, the dimples 36 can be generally evenly spaced and have a generally symmetrical pattern and can have dimples that are generally evenly sized.

Figure 3:
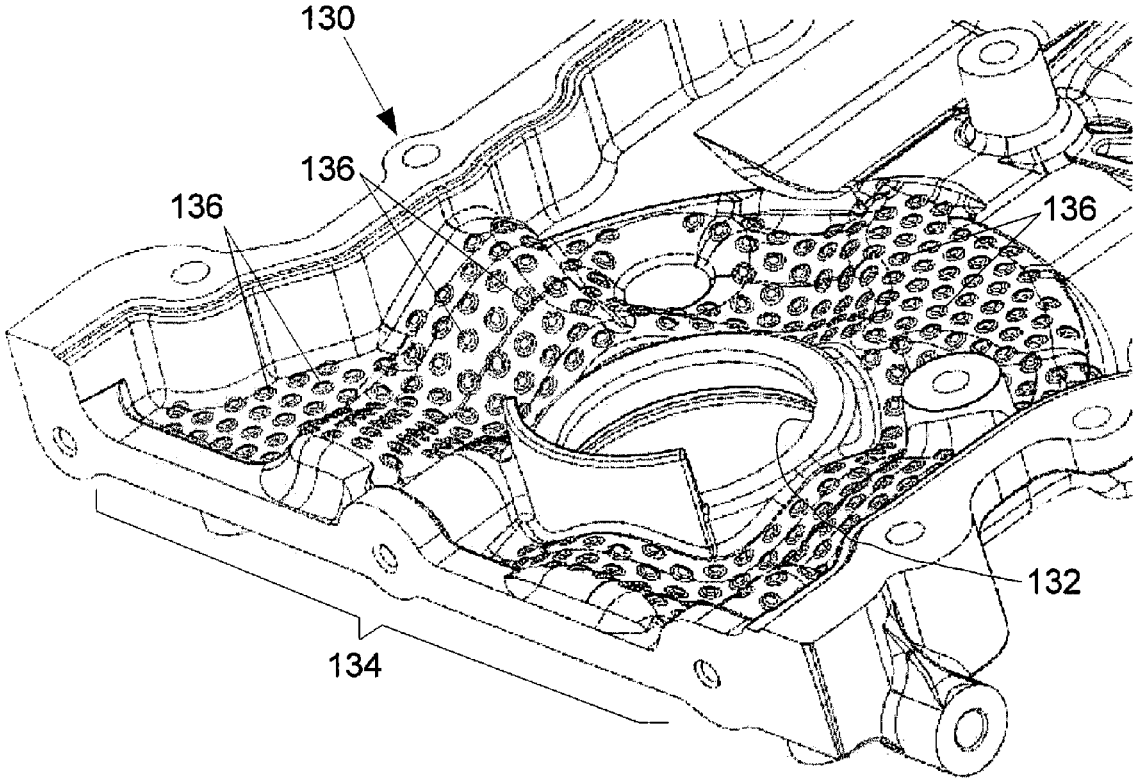
FIG. 3 is a perspective view of a portion of an engine front cover having an alternative dimple pattern with protruding dimples.

Alternatively, as illustrated in FIG. 3, the dimples 136 of the dimple pattern 134 can include a plurality of spaced protruding dimples 136.

Figure 4:
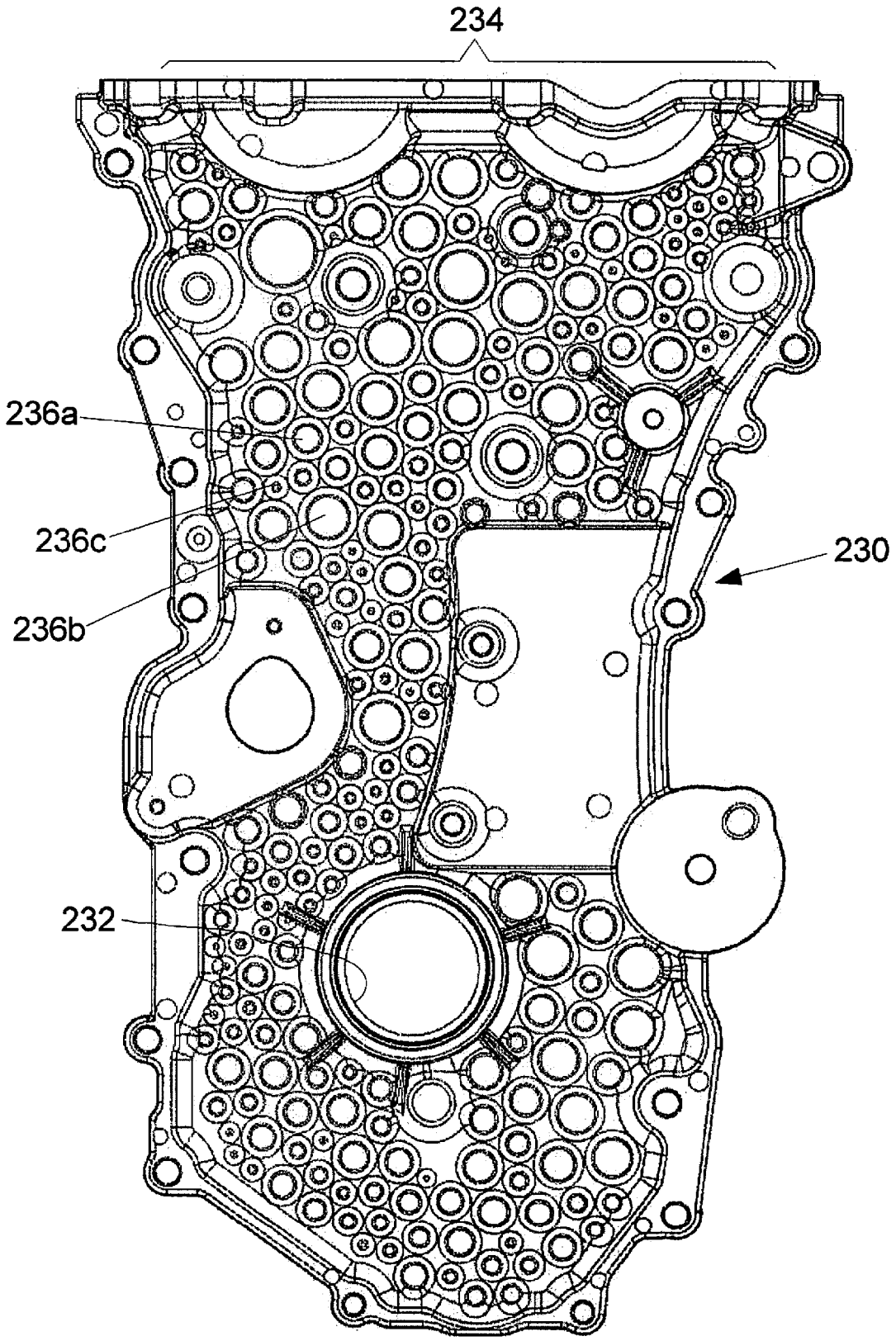
FIG. 4 is a plan view of an engine front cover having an asymmetric dimple pattern.

Furthermore, as illustrated in FIG. 4, the dimpled pattern 234 can alternatively be provided with a dimple pattern that includes dimples **236*a*-236*c* that are of different sizes and that are laid out asymmetrically. Furthermore, as illustrated in FIG. 4, the multiple sized dimples 236*a*-236*c* can be dispersed over a majority of the surface of the cover plate 230**.

Figure 5:
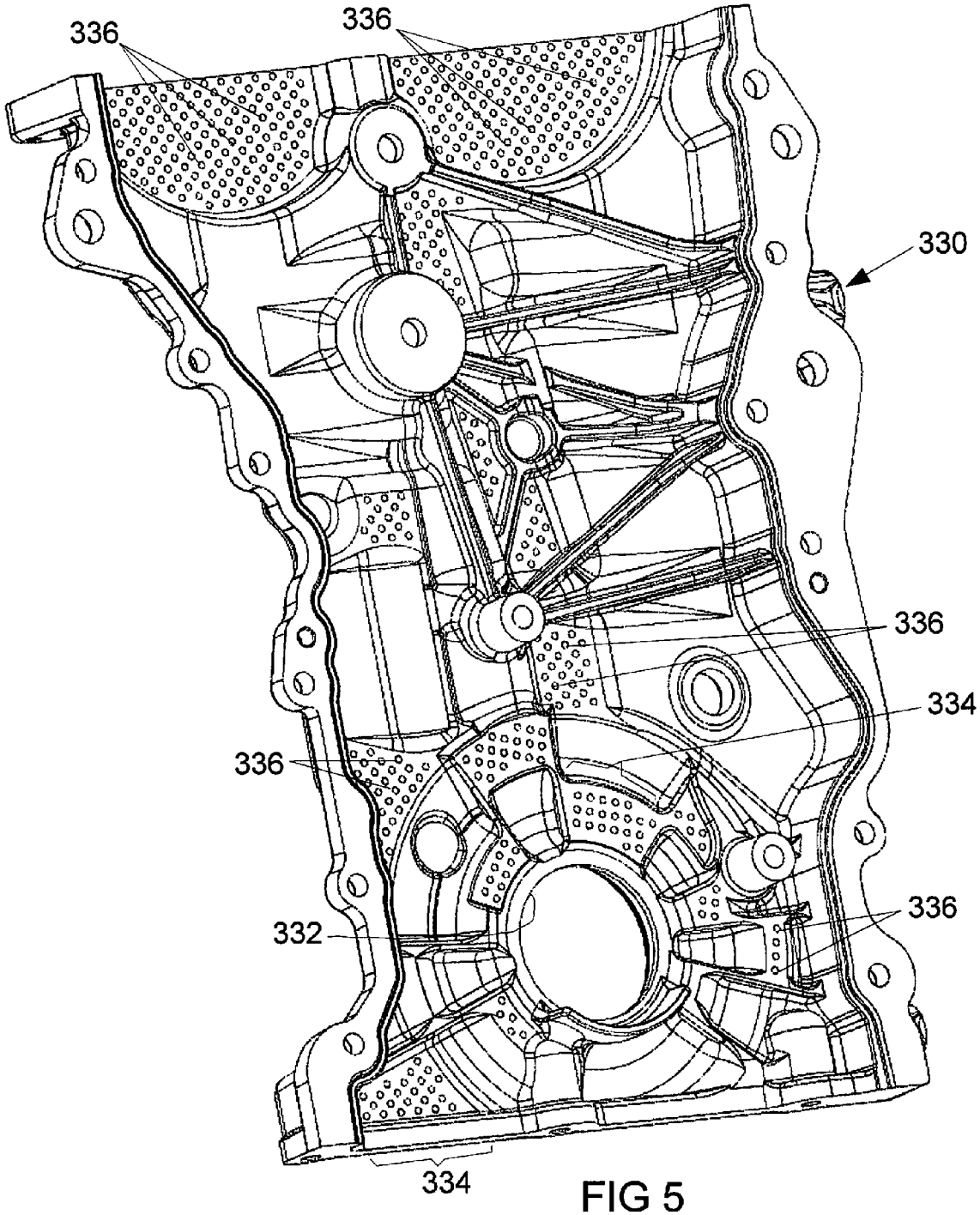
FIG. 5 is a plan view of an engine front cover having a dimple pattern in only selected regions thereof.

With reference to FIG. 5, an engine front cover 330 is shown including a dimple pattern 334 where the dimples 336 are located at various different generally flat regions of the surface of the front cover 330.

The front cover 30, 130, 230, 330 can be formed from a stamped plate, cast, or otherwise molded as is typically known in the art. The cover can be made of metal or plastic. The dimple pattern can therefore be stamped, molded, cast, or otherwise formed integrally into the cover plate or formed as an added structure to the cover plate.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An engine assembly, comprising:

a cylinder block defining a plurality of cylinders;

a plurality of pistons disposed in said plurality of cylinders;

a crankshaft drivingly attached to said plurality of pistons;

a cover mounted to an end of said block and supporting a crankshaft seal around said crankshaft, said cover including a dimpled pattern in a surface adjacent the crankshaft seal.

2. The engine assembly according to claim 1, wherein said cover is made from a cast plate.

3. The engine assembly according to claim 1, wherein said dimpled pattern includes a plurality of spaced recessed dimples.

4. The engine assembly according to claim 1, wherein said dimpled pattern includes a plurality of spaced protruding dimples.

5. The engine assembly according to claim 1, wherein said dimpled pattern includes dimples that are evenly sized.

6. The engine assembly according to claim 5, wherein said dimples are generally evenly spaced.

7. The engine assembly according to claim 1, wherein said dimpled pattern includes dimples of differing sizes.

8. The engine assembly according to claim 1, wherein said dimpled pattern includes dimples that are generally circular.

9. The engine assembly according to claim 1, wherein said dimpled pattern covers a majority of said cover.

10. The engine assembly according to claim 1, wherein said dimpled pattern completely surrounds the crankshaft seal.

11. An engine front cover, comprising:

a cast plate-like body having a plurality of mounting apertures and a hole supporting a crankshaft seal, said cast plate-like body including a dimpled pattern in a surface adjacent the crankshaft seal.

12. The engine front cover according to claim 11, wherein said dimpled pattern includes a plurality of spaced recessed dimples.

13. The engine front cover according to claim 11, wherein said dimpled pattern includes a plurality of spaced protruding dimples.

14. The engine front cover according to claim 11, wherein said dimpled pattern includes dimples that are evenly sized.

15. The engine assembly according to claim 14, wherein said dimples are generally evenly spaced.

16. The engine front cover according to claim 11, wherein said dimpled pattern includes dimples of differing sizes.

17. The engine front cover according to claim 11, wherein said dimpled pattern includes dimples that are generally circular.

18. The engine front cover according to claim 11, wherein said dimpled pattern covers a majority of said cover.

19. The engine front cover according to claim 11, wherein said dimpled pattern completely surrounds the crankshaft seal.

* * * * *